US005100178A

United States Patent [19]

MacKelvie

[11] Patent Number: 5,100,178

[45] Date of Patent: Mar. 31, 1992

[54] NOTE PAD HOLDER

[76] Inventor: Winston R. MacKelvie, Box 1156, Knowlton, Quebec, Canada, J0E 1VO

[21] Appl. No.: 519,401

[22] Filed: May 4, 1990

[51] Int. Cl.[5] ..... B42D 17/00

[52] U.S. Cl. ..... 281/44; 281/45; 281/51

[58] Field of Search ..... 281/44, 45, 51

[56] References Cited

U.S. PATENT DOCUMENTS

| | | | |
|---|---|---|---|
| 870,789 | 11/1907 | Lyon | 281/44 |
| 2,776,149 | 12/1954 | Hobbs | 281/15 |
| 3,286,388 | 10/1966 | Makiri | 281/44 |
| 3,764,167 | 10/1973 | Longarzo | 281/44 |
| 3,843,166 | 10/1974 | Barone | 281/44 |
| 3,937,491 | 2/1976 | Hilding | 281/44 |
| 4,396,209 | 8/1983 | Schultz | 281/45 |
| 4,470,571 | 9/1984 | Hartman | 281/45 |
| 4,685,701 | 8/1987 | Amundson et al. | 281/45 |
| 4,726,607 | 2/1988 | White | 281/45 |
| 4,907,824 | 3/1990 | Smirnoff | 281/45 |

FOREIGN PATENT DOCUMENTS

| | | | |
|---|---|---|---|
| 241963 | 8/1924 | Canada | 129/1 |
| 283980 | 10/1928 | Canada | 129/1 |
| 315410 | 9/1931 | Canada | 129/1 |
| 0333582 | 9/1989 | European Pat. Off. | 281/44 |

*Primary Examiner*—Douglas D. Watts
*Assistant Examiner*—Hwei-Siu Payer

[57] ABSTRACT

The invention relates to a holder comprising a frame fitted with compressible elements to provide a unique side holding force to releasably retain a note pad of the removable, self-stick variety. The side holding force is proportional to the total thickness of the material being held and allows access to the full face of the note pad surface. The side holding force and the additional benefits of material protection and widespread mountability, provides the user with access to the note pad wherever and whenever required.

18 Claims, 6 Drawing Sheets

NOTE PAD HOLDER

Figure 1:
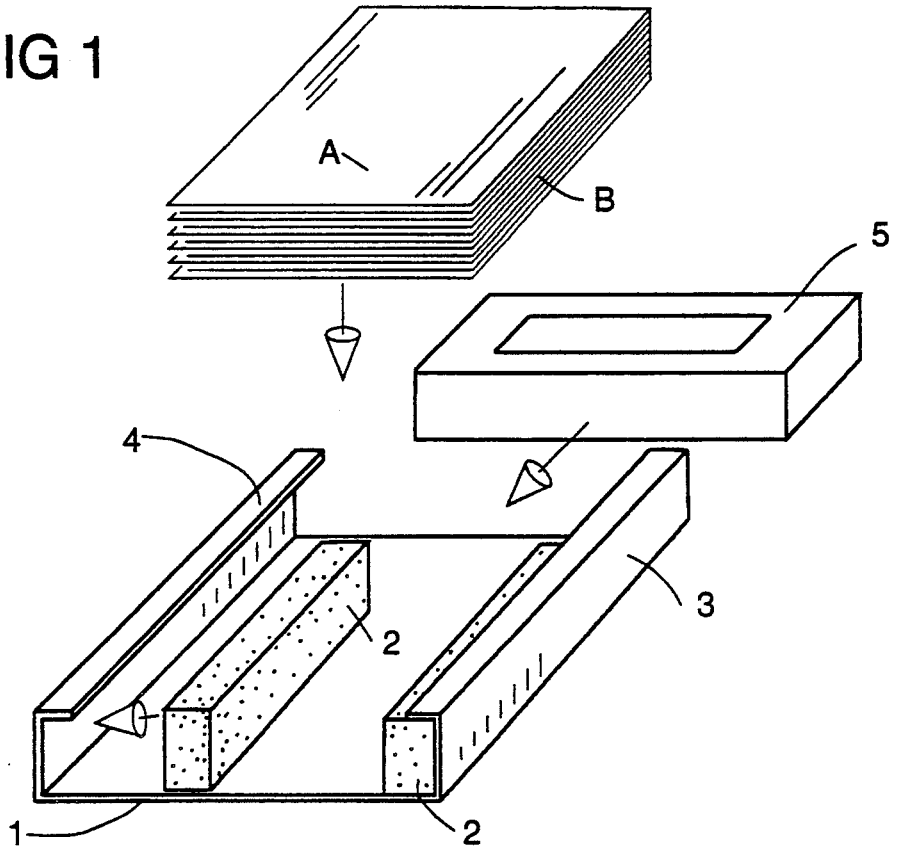

This invention relates to a holder for articles and for 'non-permanently bound sheets, of thin, stiff material', (hereinafter referred to as 'note pad'). The article may be a portable calculator or time piece while the note pad may be a loose, unbound stack of paper, or the note pad may be non-permanently bound, as in a 'self-stick replaceable note pad', e.g. the 3M Corporation's "Post-It" (Registered Trademark) note pad, or part thereof.

It is common with holders presently in use, that certain disadvantages prevent their providing convenient, widespread availability of this ubiquitous memory support system for the user. Present note pad holders are of three types. The first type is the container type, e.g. a simple 'rack, cradle or box' (hereinafter referred to as 'container'), which is primarily a stationary, desk-top accessory having the disadvantage of being unsuited for mounting on various surfaces, or for carrying on-person, due to of it's size, shape and bulkiness. The second type of note pad holder is in the form of a 'pocket, pouch or folder' (hereinafter referred to as 'wallet'), which is primarily a portable holder for loose or bound note pads. The lack of stiffness in the wallet is a disadvantage to the portability of non-permanently bound note pad, e.g. the 'self-stick note pad', which shears into pieces when roughly handled, e.g. in one's pocket. The wallet is further disadvantaged by requiring an opening manipulation to allow access to the note pad for note taking since the held material is held by the user required surface, e.g. the note pad face. Moreover, its disadvantage of not being able to be easily attached to various surfaces, e.g. a refrigerator door, further restricts the wallet type note pad holder's ability to provide widespread note pad availability for the user. The third type is the spring clip and/or clamp holder where the note material is retained from the front face and hence the self stick note pad cannot be used. Further the awkwardness of removing sheets from clip type holder where the material is held by face contact makes it disadvantageous. Moreover portability is impractical since the bulkiness constitutes an inconvenience.

I have found that these disadvantages may be overcome if the note pad holder is comprised of a stiff frame with channel shaped sides, properly dimensioned to allow fitted compressible elements to grasp, hold or retain, the note pad with a side force. A note pad is inserted Into this new type of holder by simply pressing it into place, the act of which, displaces or squeezes the compressible element a considered amount, thereby creating the side holding or retention force.

The side retaining force therefore, is proportional to the thickness and/or amount of note pad inserted. The proper side holding force will allow access to individual sheets of the note pad while securely holding the remaining note pad from accidental movement or removal. Ordinary foam insulation tape can work well in most cases. The total side holding force automatically changes as note paper is removed or added thus uniquely providing secure retention and ease of access to the full face of the note pad. The side compression elements allow this invention to be custom designed for the note pad being held-especially for the self-stick, removable note pads, whose dimensions are standardized and whose availability is world wide. Moreover the stiff frame provides self-stick note pad protection needed for rough handling, e.g. on-person portability.

Furthermore, this invention can be attached to various surfaces by using a second holder of the same design as the above but dimensioned so as to grip the sides of the above described note pad holder and fitted with two faced tape on its back to allow easy mounting virtually anywhere, including in a wallet, and easy removal of the note pad holder inserted therein: a note-pad-holder holder. Other fittings designed to connect with the frame and/or a frame mounting nut which can be provided for e.g., double-sided, adhesive tape or foam, a spring clip, a suction-cup, an articulated arm, a hook, a magnet, etc. can be easily incorporated. This holder invention thus provides the user with highly important note pad availability and widespread attachment possibilities all the while not interfering with the ease of use of the note pad.

Figure 2:
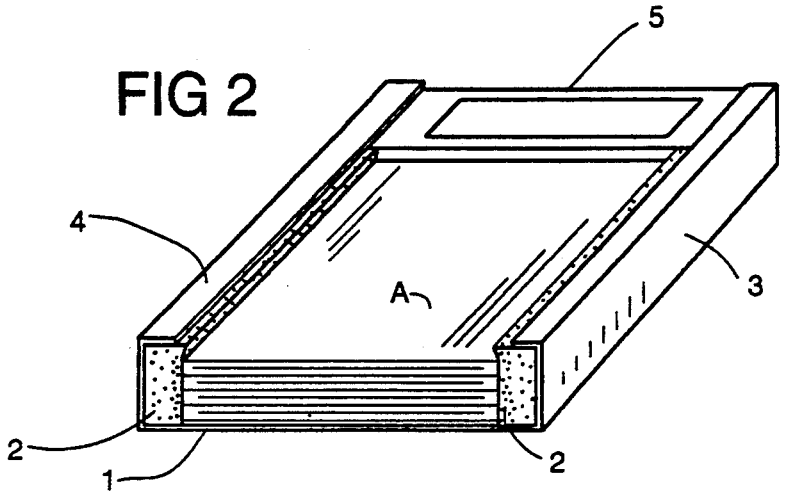
Figure 3:
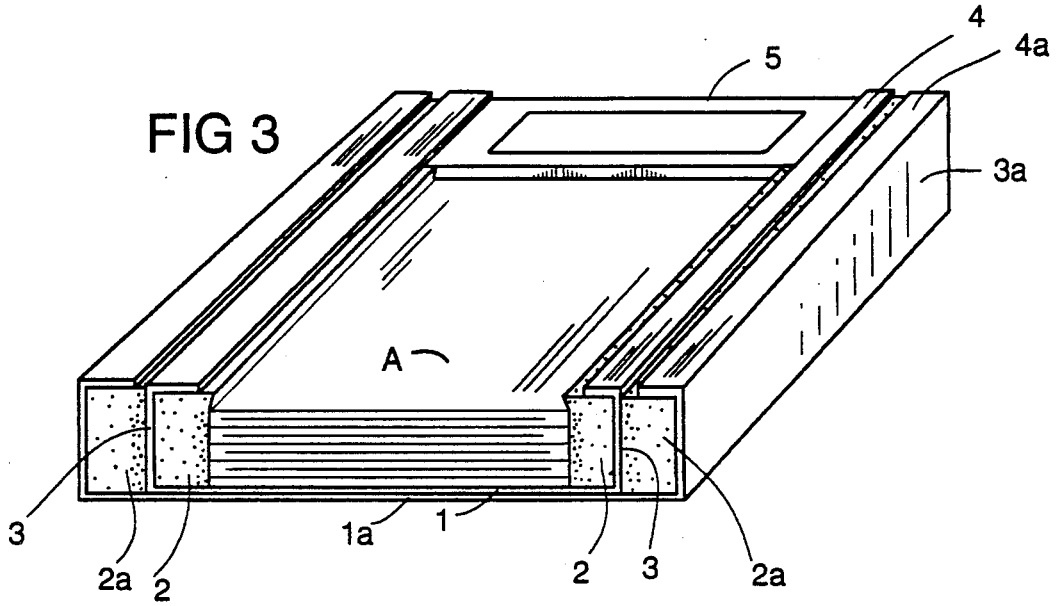
Figure 4:
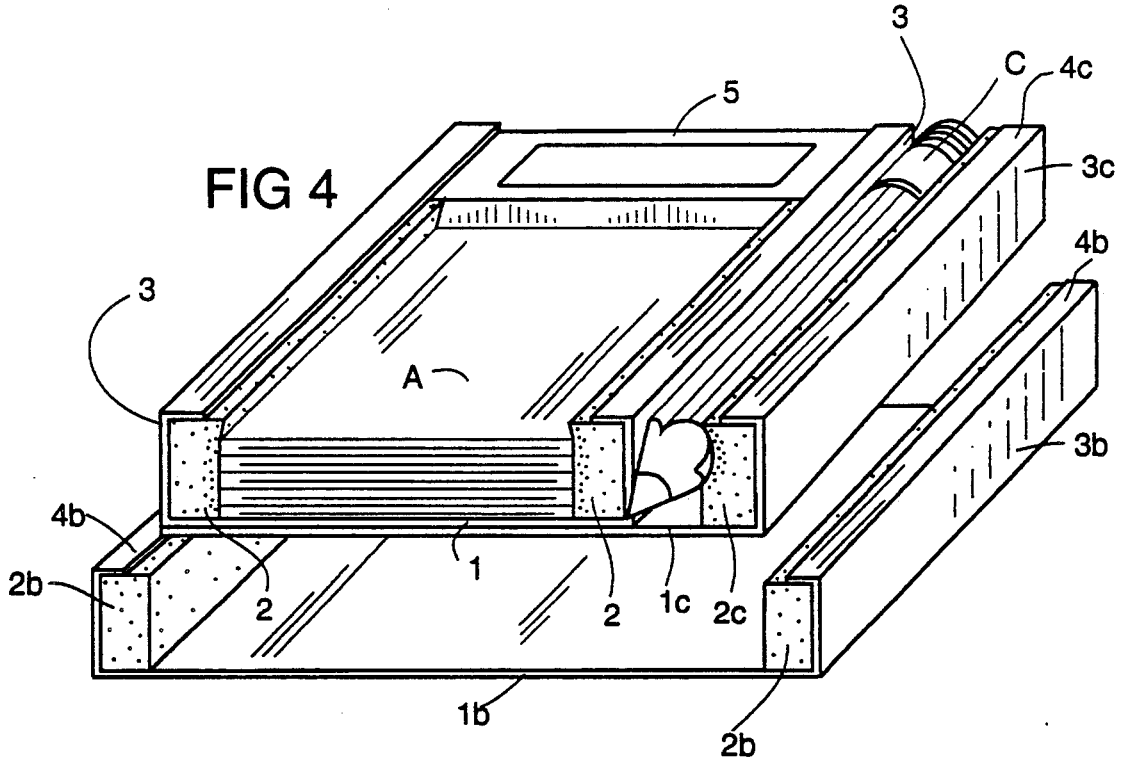
Figure 5:
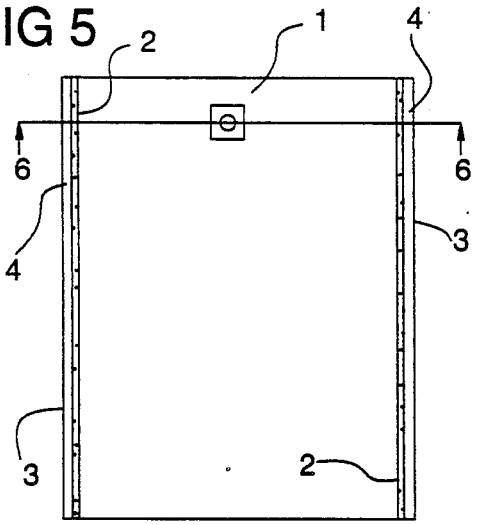
Figure 10:
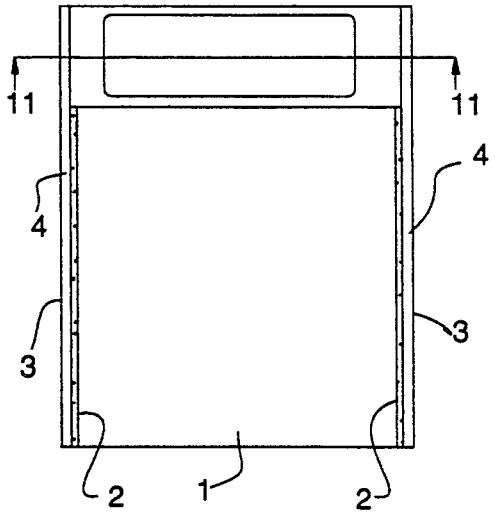
Figure 6:
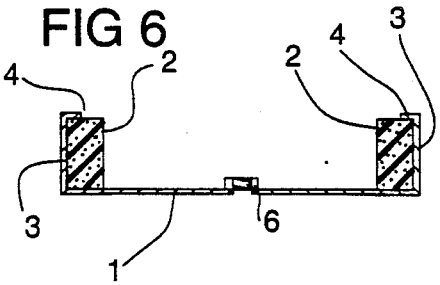
Figure 11:
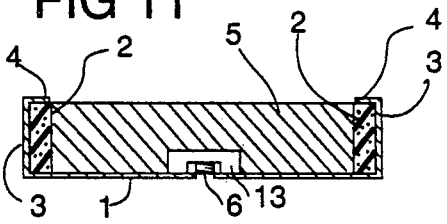
Figure 7:
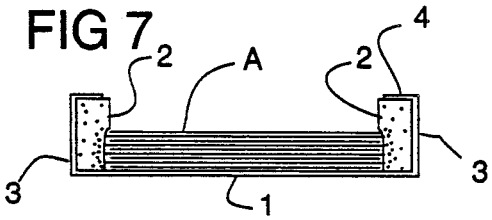
Figure 8:
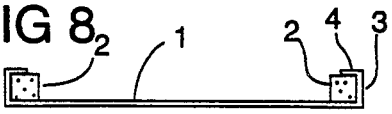
Figure 9:
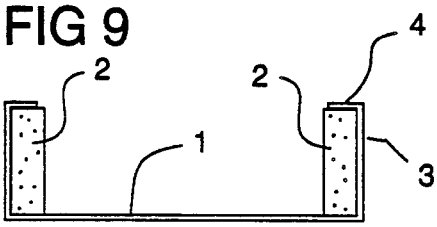
Figure 23:
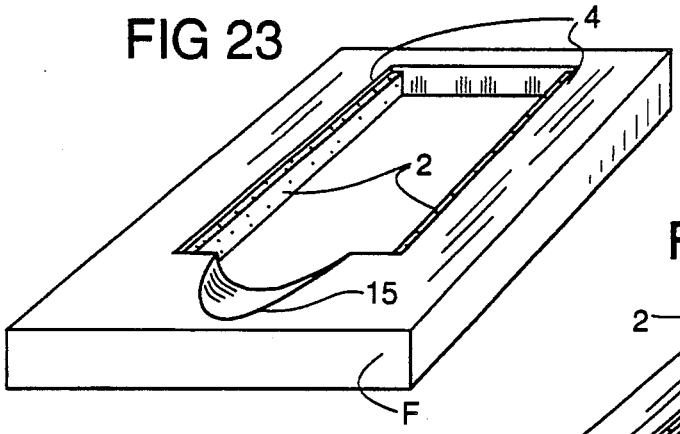
Figure 24:
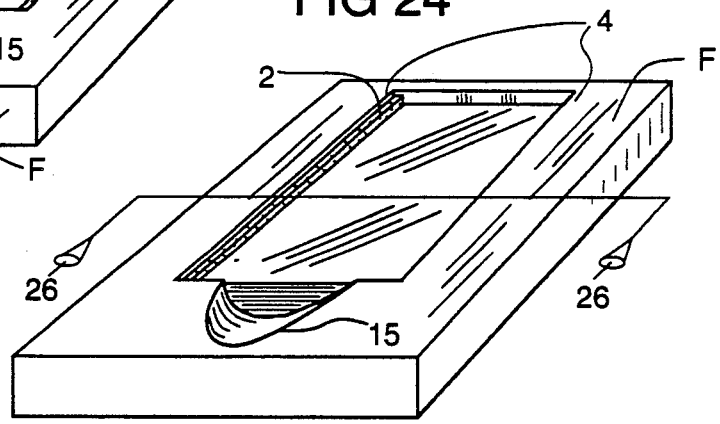
Figure 25:
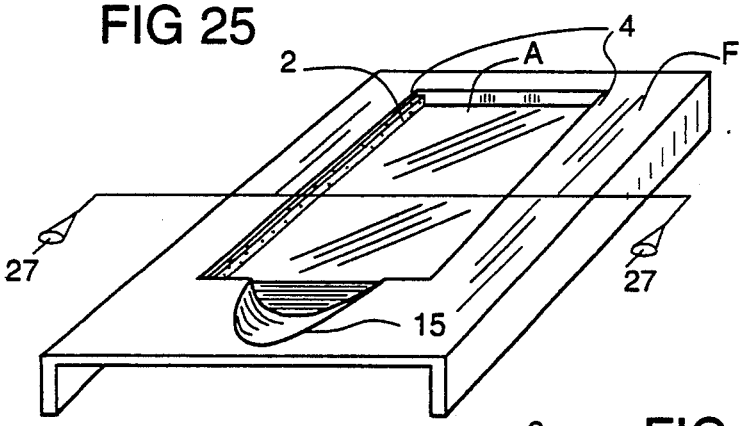

In drawings which illustrate embodiments of the invention,

FIG. 1 is an orthographic view of the components of the preferred embodiment, FIG. 2 is an orthographic view of this embodiment where the components shown in FIG. 1 are assembled into a holder, FIG. 3 shows an orthographic view of the embodiment shown in FIGS. 1 and 2, where the holder is held releasably in a second holder of this same embodiment, FIG. 4 is an orthographic view of the same embodiment as FIGS. 2 and 3 where a writing instrument is held by a similar means, FIG. 5 is a top view of another embodiment with a nut secured to the body and a section at 6—6, FIG. 6 is a section view of FIG. 5 at 6—6, FIG. 7 is an elevation view of the preferred embodiment showing the compressible elements under compression of fitted note pad, FIGS. 8, 9 is an elevation view of this embodiment with a thinner and thicker profile, FIG. 10 is a top view of the embodiment shown in FIG. 5, with a header piece fitted and a section taken at 11—11, FIG. 11 shows the section at 11—11 in FIG. 10 where a recess in the header hides the nut shown in FIGS. 5 and 6, FIGS. 12 and 13 shows a top view and elevation of another embodiment where the sides are plain edges, FIGS. 14, 15, 16, 17 and 18 show side views of the holder with various mounting attachments fitted to the back of the holder body, FIGS. 19, 20, 21 and 22 show how the variably and proportional holding force provides the unique side holding force common to all the embodiments, FIGS. 23, 24 and 25 show another embodiment where the holder is a recess in an unrelated objects.

Figure 26:
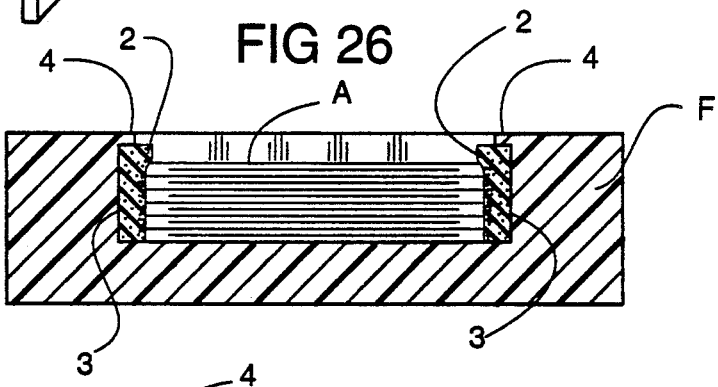
Figure 27:
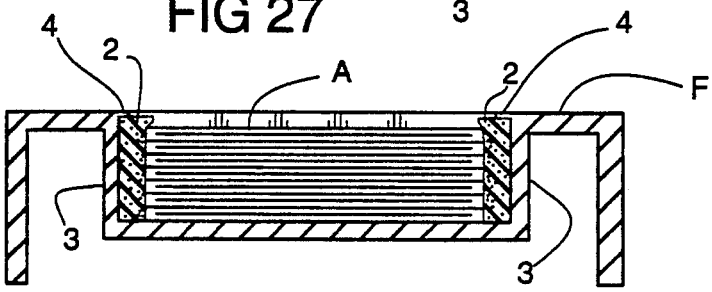

FIGS. 26 and 27 show cross-section views of FIGS. 24 and 25 respectively.

Figure 12:
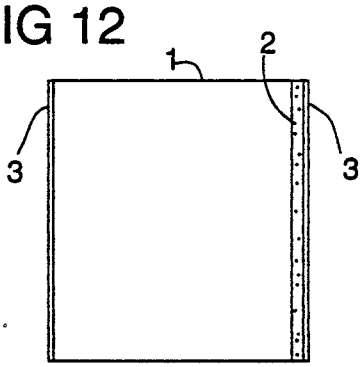
Figure 13:
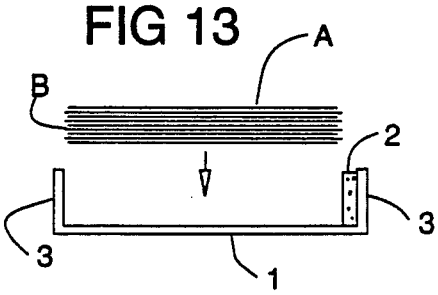
Figure 14:
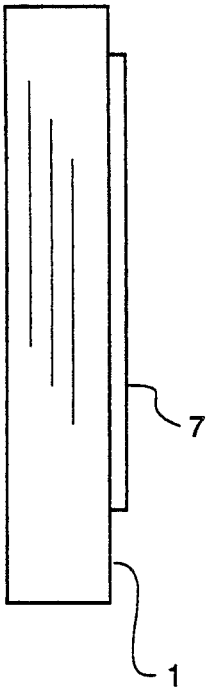
Figure 15:
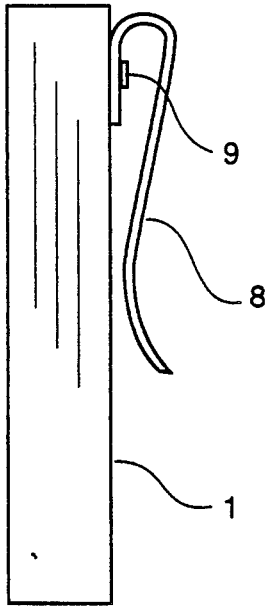
Figure 16:
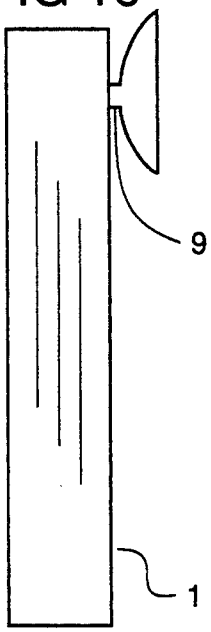
Figure 17:
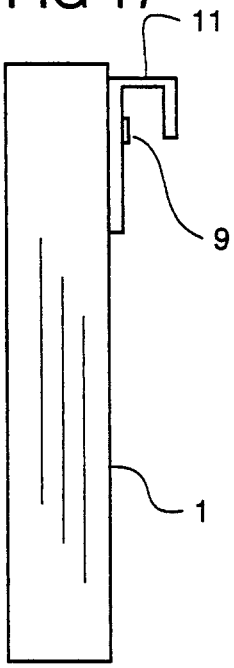
Figure 18:
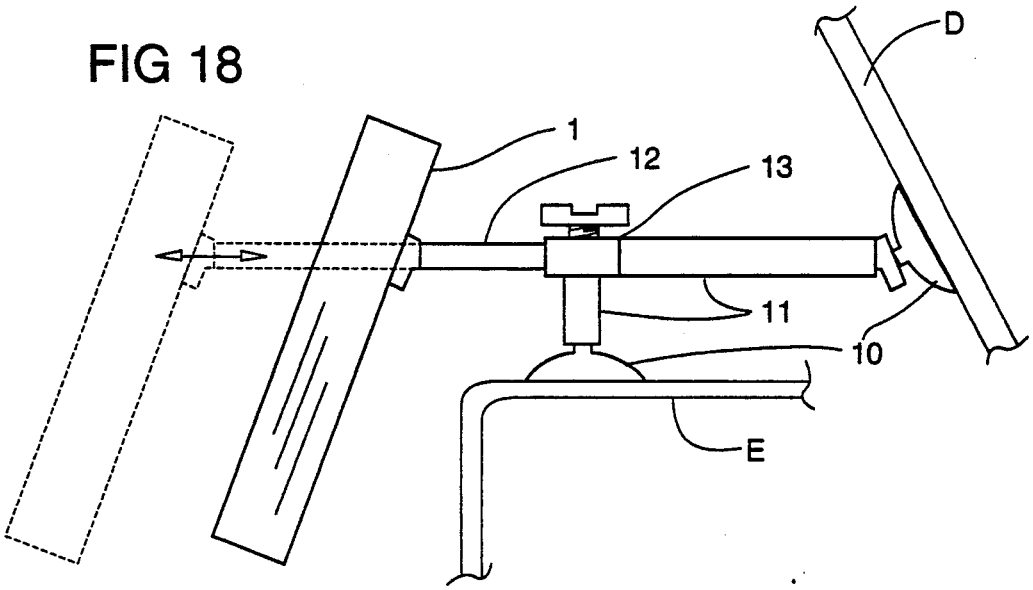
Figure 19:
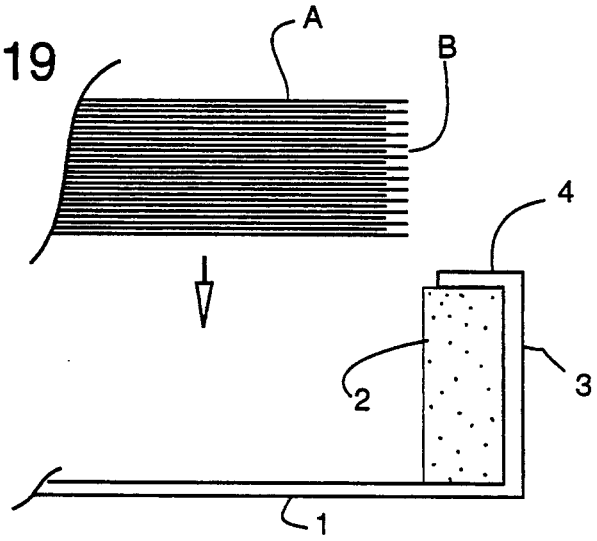
Figure 20:
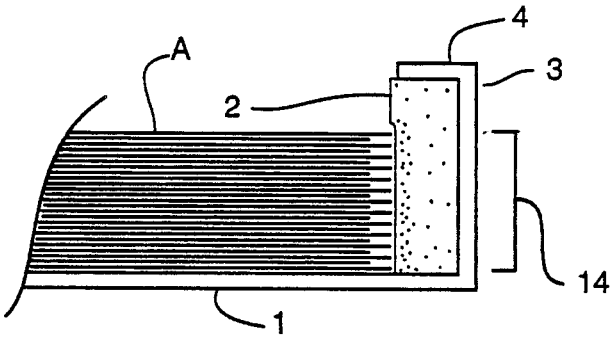
Figure 21:
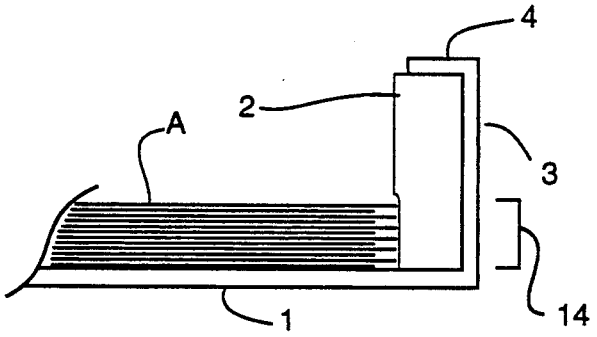
Figure 22:
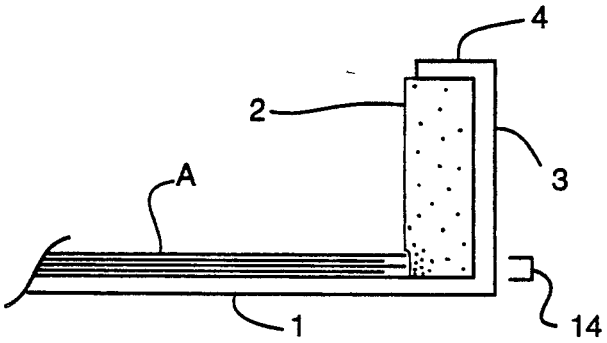

The article illustrated comprises a frame 1 with compressible element 2, (and/or 2*a*, 2*b* and 2*c*), to hold note pad A by it's Side Surface B. 1*a* and 1*b*, 1*c* in FIGS. 3 and 4 respectively, are also frame members of other embodiments. Any suitable cross section and material may be used in the construction of 1, but, in the form shown, it is a rectangular channel, with sides 3, (and/or 3*a*, 3*b* and 3*c*) and flanges 4, (and/or 4*a*, 4*b* and 4*c*) forming a channel open at both ends and fitted with two of 2 which may be made of a foam-rubber like material as shown, or may be bristle, or fibrous matter, securely fitted to 3 of 1 and are chosen to provide the side holding force 14 required as shown in FIGS. 7, 19, 20, 21 and 22. The characteristics of 2 include compression or displacement stiffness, surface friction, and amount of compression generated by the respective dimensions chosen for 2, and for 1 as demanded by the dimensions of A. The proper side holding force will allow the individual sheet access required, but prevent accidental movement or removal, of A. Header 5, might be advertizing, a calculator or timepiece or combinations thereof and may also serve as a cover for Mounting Nut 6 if fitted, as shown in FIGS. 5, 6 and 11. FIGS. 6 and 11 shows 6 firmly attached to 1. Said 6 could also be an integral part of 5, such that connecting a mounting attachment to 6, would hold 1 in a 'sandwich' condition, between 5 and 6. Nut 6 allows the attachment of a variety of suitable mounting hardware which include screw 9 as shown in FIG. 15, spring clip 8 shown in FIG. 15, suction cup 10 shown in FIG. 16, hook 11 shown in FIG. 17, and in FIG. 18 an extendable mount 12, which connects to hardware 11 and lock 13, all of which attaches to an automobile windshield D and dash board E. In FIG. 14 double sided and/or magnetic tape 7 is shown fitted to the back of 1. In FIGS. 12 and 13, 3 is indicated without 4. FIGS. 7, 20, 21 and 22 shows how A displaces 2 sideways creating the side holding force 14. FIGS. 8 and 9 show embodiments where the overall thickness of the holder is adapted as needed. FIG. 1 is an exploded view of the preferred embodiment. FIG. 3 shows this embodiment retained in another holder of the same embodiment. FIG. 4 shows the preferred embodiment where a writing instrument C is fitted to a single 2 and the whole assembly releasably retained in another holder which can be permanently mounted to another surface using the backside of 1 as the mounting surface. FIG. 23 shows an embodiment where 1 is as a recess in an unrelated object, e.g. a telephone shown as F in the drawings 23–27. FIG. 24 shows this embodiment with A fitted. FIG. 25 shows another embodiment where 1 and 2 are as a recess molded into a thin housing, e.g. a computer keyboard also shown as F. Groove 15 in FIGS. 24–25 provides access to the pad edge. In the preferred embodiment shown in FIGS. 3 and 4, the holder of the holder is dimensioned so as to provide a side grip on the outer sides 3 of 1.

FIGS. 26 and 27 are cross-sectional view of FIGS. 24 and 25 respectively and show the unrelated object F with molded-and/or formed—channel walls 3 fitted with compression elements 2 and with note pad A compressing the compressible elements and retaining itself therein. A depression 15 formed in object F provides finger access to note pad A.

Other ways in which the invention may be used include:

fitting a hinged cover to 1 thereby providing a book-like format as well as a place on the inside of the cover to store written 'self-stick' notes while exposing a new note surface.

As a price tag and/or information holder on a store shelf where price and/or descriptive note pad is held for quick access and change.

As a holder for business cards and/or credit cards.

The Frame 1 could be double-sided with a different note pad accessible from either side.

Provided for in the design of attaché cases, telephone equipment, instruments, automobiles, refrigerator doors or anywhere else needed.

As a stationary holder with sufficient mass to allow access without unwanted movement, as in a desk top dispenser.

While I have illustrated and described the preferred form of construction for carrying my invention into effect, this is capable of variation and modification, without departing from the spirit of the invention. I therefore do not wish to be limited to the precise details of construction setforth, but desire to avail myself of such variations and modifications as come within the scope of the appended claims.

I claim:

1. A holder in combination with sheet material, said sheet material comprising a plurality of substantially rectangular sheets having a length and a width, said holder comprising a base, first and second opposed side walls extending upwardly from said base to thereby define a sheet material receiving area, a flange extending inwardly from said first side wall towards said second side wall to thereby define a generally U-shaped channel extending along at least a portion of said first side wall, at least one compressible element secured to said first side wall, the distance between said second side wall and said compressible element on said first side wall being equal to or slightly less than the width of the sheet material such that said compressible element exerts a side holding force on said sheet material.

2. The combination of claim 1 further including a second compressible element secured to said second side wall, the distance between the first and second compressible elements being slightly less than the width of the sheet material such that both said compressible elements exert a side holding force on said sheet material.

3. The combination of claim 2 wherein said holder includes means for securing the holder to a substrate.

4. The combination of claim 3 wherein said holder includes a second article receiving area, said second article containing area being adapted to receive a writing instrument.

5. The combination of claim 1 wherein said sheet material comprises a plurality of sheets of note paper.

6. The combination of claim 5 wherein said sheets of note paper comprise a note pad of the self stick type.

7. The combination of claim 5 wherein said second side wall has a flange extending inwardly towards the flange of said first side wall said flanges extending inwardly a distance less than the width of their respective compressible elements such that the flanges provide protection for the compressible elements while permitting easy removal of the sheets from the sheet material receiving area.

8. In an article of manufacture, the improvement comprising an integrally formed holder for sheet material, said holder comprising a base portion, first and second opposed side walls extending upwardly from said base to thereby define an article receiving area, a flange extending inwardly from said first side wall towards said second side wall to thereby define a generally U-shaped channel extending along at least a portion of said first side wall, a compressible element affixed to said first side wall, said compressible element being adapted to exert a side holding force on an article placed in said article receiving area.

9. The improvement of claim 8 further including a second compressible element secured to said second side wall.

10. The improvement of claim 8 wherein said article of manufacture has a planar surface and said holder is molded therein, the base portion of said holder being below said planar surface and said first and second side walls extending between said planar surface and said base portion of the holder.

11. The improvement of claim 10 further including a recess formed in said planar surface, said recess communicating with said article receiving area to permit finger access to contents thereof.

12. In combination, a primary holder and a secondary holder, said secondary holder being adapted to hold sheet material, said secondary holder comprising a base, first and second opposed side walls extending upwardly from said base to define a sheet material receiving area therebetween, a flange extending inwardly from said first side wall towards said second side wall to thereby define a generally U-shaped channel extending along at least a portion of said first side wall, and at least one compressible element adjacent said first side wall, said primary holder comprising a base, first and second opposed side walls extending upwardly from said base to define an article receiving area therebetween adapted to receive said secondary holder, at least one compressible element secured to said first side wall, the distance between said second side wall and said compressible element on said first side wall being slightly less than the width of said secondary holder such that said compressible element exerts a side holding force on said secondary holder to retain it in place.

13. The combination of claim 12 further including a flange extending inwardly from said first side wall of said primary holder towards said second side wall to thereby define a generally U-shaped channel at said first side wall, said compressible element having a width greater than the width of said flange such that it extends past said flange towards said article receiving area.

14. The combination of claim 12 wherein said secondary holder further includes a second article receiving area, said second article receiving area being adapted to receive a writing instrument.

15. Holder for an article, said holder comprising a base, first and second opposed side walls extending upwardly from said base to define an article receiving area therebetween, a flange extending inwardly from said first side wall towards said second side wall to thereby define a generally U-shaped channel extending along at least a portion of said first side wall, a compressible element adjacent at least a portion of said first side wall in said channel, said compressible element having a width greater than the width of said flange such that it extends past said flange towards said article receiving area.

16. The holder of claim 15 further including means for securing said holder to a surface.

17. The holder of claim 15 wherein said second side wall also has an inwardly extending flange to define a second generally U-shaped channel at said second side wall, a second compressible element within said second channel adjacent said second side wall, said compressible element having a width greater than the width of said flange such that the compressible element extends past said flange into the article receiving area.

18. The holder of claim 17 wherein said compressible elements within said channels are secured to their respective side walls.

* * * * *